US005551276A

United States Patent [19]

Hild

[11] Patent Number: 5,551,276

[45] Date of Patent: Sep. 3, 1996

[54] UPSETTING PRESS MAIN DRIVE

[75] Inventor: Berghold Hild, Burbach, Germany

[73] Assignee: SMS Schloemann-Siemag Aktiengesellschaft, Düsseldorf, Germany

[21] Appl. No.: 263,614

[22] Filed: Jun. 29, 1994

[30] Foreign Application Priority Data

Jun. 18, 1993 [DE] Germany ..... 43 20 213.6

[51] Int. Cl.[6] ..... B21J 7/18

[52] U.S. Cl. ..... 72/453.1; 72/206; 72/453.18

[58] Field of Search ..... 72/453.18, 453.02, 72/206, 407, 453.1

[56] References Cited

U.S. PATENT DOCUMENTS

| | | | |
|---|---|---|---|
| 4,235,088 | 11/1980 | Kreiskorte | 72/453.18 |
| 4,578,983 | 4/1986 | Kimura | 72/407 |
| 5,379,628 | 1/1995 | Pahnke et al. | 72/453.18 |

FOREIGN PATENT DOCUMENTS

| | | | |
|---|---|---|---|
| 0112516 | 5/1988 | European Pat. Off. . | |
| 1266111 | 4/1968 | Germany | 72/453.18 |
| 2345527 | 3/1975 | Germany . | |
| 621870 | 6/1961 | Italy | 72/453.18 |
| 58924 | 5/1978 | Japan | 72/453.18 |
| 91476 | 4/1958 | Norway | 72/453.18 |
| 2016980 | 9/1979 | United Kingdom | 72/453.18 |
| 2042388 | 9/1980 | United Kingdom | 72/453.18 |

*Primary Examiner*—David Jones
*Attorney, Agent, or Firm*—Friedrich Kueffner

[57] ABSTRACT

A method of operating pressing tools of an upsetting press for rolling stock and an upsetting press for reducing the width of rolling stock, wherein pressing tools arranged on both sides of the rolling stock each have hydraulic reduction drives which effect a movement of the pressing tools essentially toward each other and away from each other. The upsetting press may include feed drives which are capable of driving the pressing tools in the feeding direction of the rolling stock. The method includes effecting the return strokes of the reduction drives by work pumps, wherein the pressure medium displaced from the pressing cylinders of the reduction drive is received by a pressure medium accumulator, and wherein for the forward strokes the pressure medium from the pressure medium accumulator operates parallel to the work pumps at least until the pressing tools make contact with the rolling stock.

13 Claims, 2 Drawing Sheets

UPSETTING PRESS MAIN DRIVE

BACKGROUND OF THE INVENTION

1. Field of the Invention

The present invention relates to a method of operating pressing tools of upsetting presses for rolling stock, wherein the pressing tools are provided with hydraulic reduction drives. The present invention further relates to an upsetting press for reducing the width of rolling stock, wherein pressing tools arranged on both sides of the rolling stock each have hydraulic reduction drives which effect a movement of the pressing tools essentially toward each other and away from each other. The upsetting press may include feed drives which are capable of driving the pressing tools in the feeding direction of the rolling stock.

2. Description of the Related Art

It is known in the art to drive upsetting presses by means of electric motors through gear systems and eccentrics. Components having a relatively large structural size are required for converting the rotary movement into a linear movement. In addition, the manufacturing costs of such drives are very high.

For example, European Patent 0 112 516 proposes hydraulic reduction drives which produce direct linear movements, require less space and are less expensive to manufacture. However, in order to be able to apply the power necessary for the reduction, pumps must be installed which are relatively large, have a high power and, thus, consume a lot of energy.

SUMMARY OF THE INVENTION

Therefore, it is the primary object of the present invention to further develop the method described above for operating the reduction drive of an upsetting press and the reduction drive itself in such a way that pumps can be used which are very inexpensive, relatively small and require less energy.

In accordance with the present invention, the method of operating the pressing tools of upsetting presses for rolling stock includes effecting the return strokes of the reduction drives by means of work pumps, wherein the pressure medium displaced from the pressing cylinders of the reduction drive is received by a pressure medium accumulator, and wherein for the forward strokes the pressure medium from the pressure medium accumulator operates parallel to the work pumps at least until the pressing tools make contact with the rolling stock.

In the upsetting press for the reduction of the width of rolling stock according to the present invention, each reduction drive has at least one pressing cylinder which is connected to at least one work pump. A pressure medium accumulator arranged parallel to the work pump is connected through a valve, preferably an accumulator metering valve, to the work pump and the pressing cylinder.

The arrangement of a pressure medium accumulator in the feeding circuit has the result that the large pressure medium volumes from the pressing cylinder, which are not required for feeding the pumps and return stroke cylinders during the return stroke, are no longer discharged into a tank unused. Rather, the pressure medium is stored in the pressure medium accumulator and is subsequently used during the forward movement of the pressing cylinder.

The volumetric flow of the pressure medium from the pressure medium accumulator makes it possible during the forward stroke of the pressing cylinder to increase the adjusting speed of the pressing cylinder when the volumetric flow has a certain value determined by the work pumps. However, the increase of the speed is only achieved with respect to the empty stroke of the pressing cylinder, since the pressure of the pressure medium accumulator is not sufficient for additionally significantly contributing to the pressing stroke.

Accordingly, the work pumps do not have to be designed for the large volumetric flows which are required for a fast forward movement of the pressing cylinder in the empty stroke and, thus, may have smaller dimensions.

Moreover, the pump may have a low nominal rating because, due to the presence of the pressure medium accumulator, the pump is operated only for very short periods of time.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
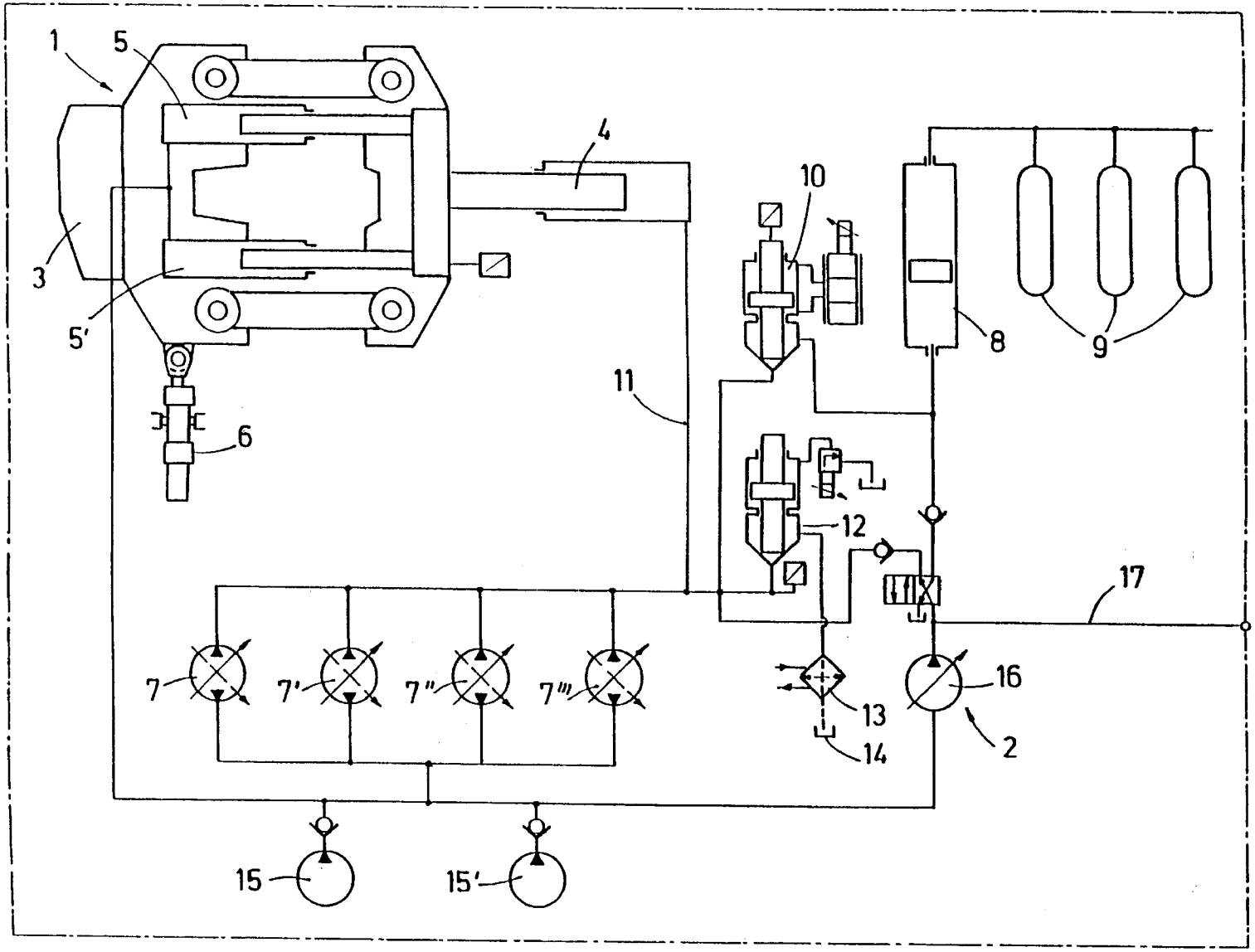
FIG. 1 is a schematic diagram showing the upsetting press reduction drive according to the present invention, with half-closed circulation system and pump metering.

The figures of the drawing each show half of an upsetting press 1. The second half of the upsetting press, not shown, is arranged in a mirror-inverted configuration relative to the first half. Both halves are connected to each other through a synchronization control 2.

As illustrated in FIG. 1, the upsetting press 1 includes a pressing tool 3 which is connected to a pressing cylinder 4 and two return stroke cylinders 5, 5'. FIG. 1 further shows a feed cylinder 6 which, in the case of flying operation, drives the pressing tool 3 at the rolling stock speed in the longitudinal direction of the rolling stock. The pistons of the cylinders 4, 5, 5' are constructed as plungers, wherein the effective piston surface of the pressing cylinder 4 is greater than the effective piston surface of the two return stroke cylinders 5, 5'. The pressing cylinder 4 is connected to the return stroke cylinders 5, 5' through work pumps 7, 7', 7", 7'".

A pressure medium accumulator 8 is provided between the work pumps 7, 7', 7", 7'" and the pressing cylinder 4. The pressure medium accumulator 8 is a piston-type accumulator. Accumulators 9 containing a gas as pressure cushion are connected to the pressure medium accumulator 8. The pressure medium accumulator 8 is connected to the feeding circuit 11 through an accumulator metering valve 10. The accumulator metering valve 10 is controlled with respect to its travel in dependence on the pressure cylinder pressure and possibly in dependence on the time.

A pump metering valve 12 which is also controlled in dependence on time and pressure serves for a discharge of the feeding circuit 10 through a cooling unit 13 to the tank 14. Pressure medium for the forward movement of the pressing cylinder 4 can be supplied from the tank 14 through feed pumps 15', 15' to the work pumps 7, 7', 7", 7'". The synchronized operation of the two halves of the upsetting press can be controlled through a pump 16 and a compensating circuit 17 by means of the synchronization unit 2, not illustrated in more detail.

The drive illustrated in FIG. 1 operates as follows. Starting from the last pressing stroke, i.e., when the plunger of the pressing cylinder 4 is in its forward position, the pumps 7, 7', 7", 7'" are reversed through zero, so that the pressure medium is applied to the return stroke cylinders 5, 5'. As a result, pressure medium is pushed out of the pressing cylinder 4. However, because of the fact that the plunger of the pressing cylinder 4 has an effective surface area which is of a different size than the effective surface areas of the plungers of the return stroke cylinders 5, 5', substantially more pressure medium is pushed out of the pressing cylinder 4 than would be required for driving the plungers of the return stroke cylinders 5, 5'. The excess pressure medium is returned through the open accumulator metering valve 10 to the pressure medium accumulator 8. Once the pressure medium accumulator 8 is filled, or even possibly already during the filling procedure, the pump metering valve 12 is opened in order to conduct any additional excess pressure medium through the cooling unit 13 to the tank 14.

When the plungers of the return stroke cylinders 5, 5' have reached the forward position thereof, the work pumps 7, 7', 7", 7'" are switched through zero into the oppositely directed conveying direction. Simultaneously, the accumulator metering valve is opened, so that, with the pump metering valve 12 being closed, the work pumps, 7, 7', 7", 7'" convey pressure medium to the pressing cylinder 4 from the return stroke cylinders 5, 5'and the feed pumps 15, 15' and simultaneously from the pressure medium accumulator 8. This large volumetric flow causes the plunger of the pressing cylinder 4 to be moved quickly forwardly. However, when the tool 1 of the upsetting press makes contact with the rolling stock, the pressure at the cylinder 4 increases. Once this pressure exceeds the pressure of the pressure medium accumulator 8, the accumulator metering valve is closed and the work pumps 7, 7', 7", 7'" serve by themselves to carry out the pressing stroke, at an appropriately reduced speed. Prior to the first work stroke with the upsetting press 1 being open, filling of the pressure medium accumulator 8 can also be effected by the work pumps 7, 7', 7", 7'".

Figure 2:
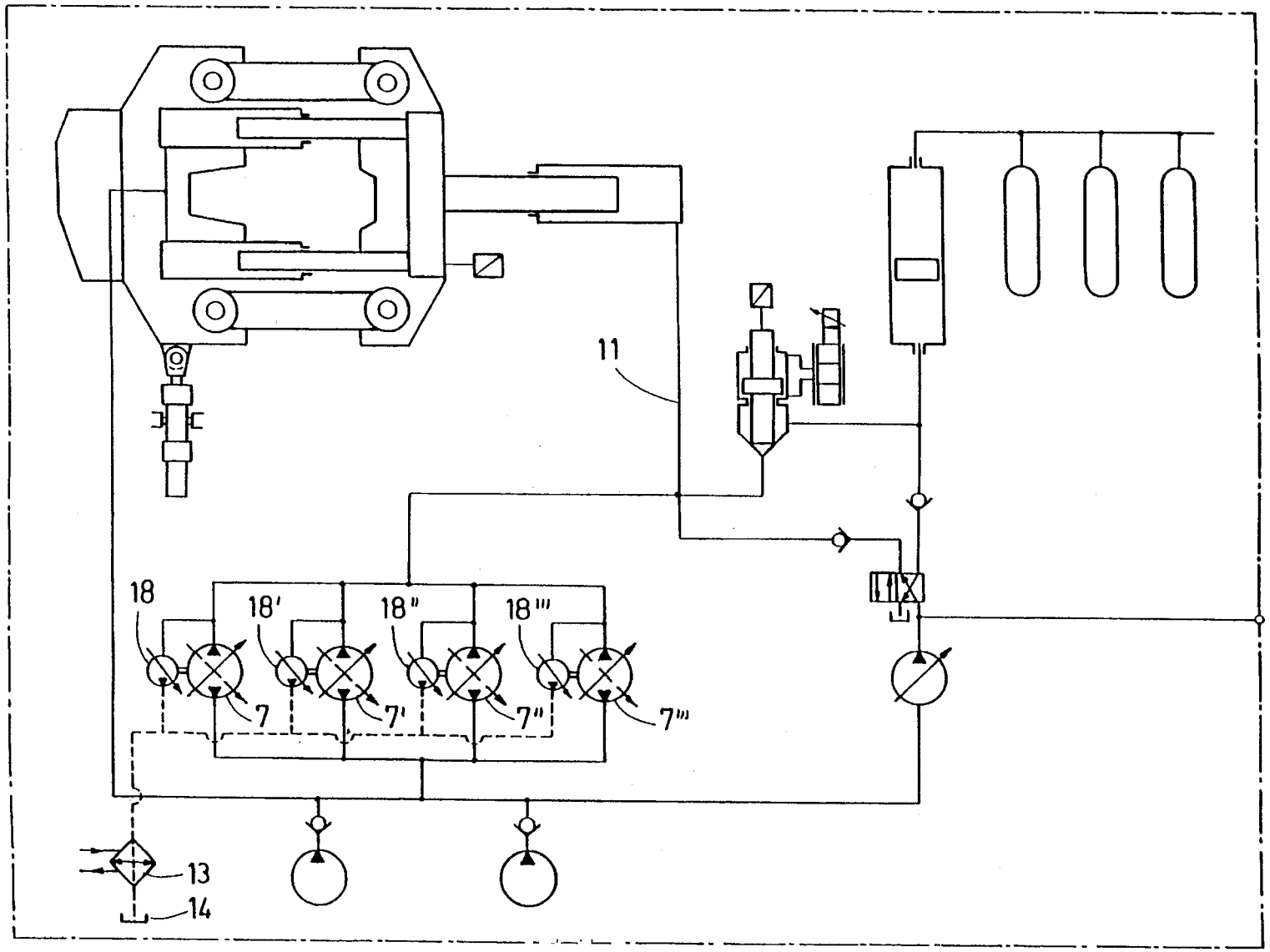
FIG. 2 is a schematic diagram showing the upsetting press reduction drive according to the present invention, with half-closed circulation system and hydraulic motor volumetric flow compensation.

The embodiment of the drive illustrated in FIG. 2 is very similar to the one illustrated in FIG. 1, so that only the differences between the two embodiments will now be discussed. Instead of the pump metering valve 12, hydraulic motors 18, 18', 18", 18'" are connected in parallel to the work pumps 7, 7', 7", 7'". As is true for the pump metering valve 12 shown in FIG. 1, the hydraulic motors 18, 18', 18", 18'" are connected to the feeding circuit 11 between the pressing cylinder 4 and the work pumps 7, 7', 7", 7'". The respective second connection of the hydraulic motors 18, 18', 18", 18'" is connected through the cooling unit 13 to the tank 14.

The hydraulic motors 18, 18', 18", 18'" are driven by the excess pressure medium when the pressure cylinders 4 are pushed back. Since the hydraulic motors are coupled to the work pumps 7, 7', 7", 7'", the drive motors of the pumps are relieved, so that a further reduction of the required energy is achieved.

The invention is not limited by the embodiments described above which are presented as examples only but can be modified in various ways within the scope of protection defined by the appended patent claims.

I claim:

1. A method of operating pressing tools of an upsetting press for rolling stock, the pressing tools including hydraulic reduction drives, the reduction drives carrying out forward strokes and return strokes, wherein each reduction drive has a pressing cylinder, further including work pumps and return stroke cylinders forming together with the reduction drives an essentially closed circuit, the method comprising effecting the return strokes of the reduction drives by means of the work pumps, conducting pressure medium displaced from the pressing cylinders into a pressure medium accumulator, and utilizing the pressure medium in the pressure medium accumulator for effecting the forward strokes together with the work pumps at least until the pressing tools contact the rolling stock.

2. The method according to claim 1, further comprising synchronizing the operation of the hydraulic reduction drives.

3. The upsetting press according to claim 1, wherein the at least one work pump is a pump which is adjustable through zero.

4. An upsetting press for reducing the width of rolling stock, the upsetting press comprising a pressing tool each on both sides of the rolling stock, each pressing tool comprising a hydraulic reduction drive, such that the reduction drives effect movement of the pressing tools essentially toward each other and apart from each other, each reduction drive comprising at least one pressing cylinder and a return stroke cylinder, at least one work pump connected to the pressing cylinder and to the return stroke cylinder so as to form an essentially closed circuit, further comprising a pressure medium accumulator connected parallel to the work pump, and a valve, the work pump being connected to the pressing cylinder through the valve.

5. The upsetting press according to claim 4, wherein the upsetting press further comprises feed drives for driving the pressing tools in a feeding direction of the rolling stock.

6. The upsetting press according to claim 4, wherein the valve is an accumulator metering valve.

7. The upsetting press according to claim 4, the return stroke cylinders comprising pistons having an effective pressure area size, the pressing cylinders comprising pistons having an effective pressure area size, wherein the effective pressure area size of the pistons of the return stroke cylinders is smaller than the effective pressure area size of the pistons of the pressing cylinders.

8. The upsetting press according to claim 7, wherein the pressing tools comprise position sensors for determining actual position values, the position sensors being connected to a control device for controlling a synchronized operation between the two pressing tools, wherein the control device operates with a pump for effecting a synchronized operation.

9. The upsetting press according to claim 8, wherein the work pumps of the pressing cylinders and the return stroke cylinders form a drive circuit, the drive circuit including at lease one feed pump for compensating a pressure medium loss and for feeding any pressure medium required for operating the circuit.

10. The upsetting press according to claim 9, wherein the drive circuit includes a feeding circuit, a pump metering valve being connected in parallel to the work pump in the feeding circuit, the pump metering valve being controlled for supplying pressure medium to a cooler and subsequently to a tank.

11. The upsetting press according to claim 10, wherein the pump metering valve is controlled in dependence on pressure.

12. The upsetting press according to claim 9, further comprising adjustable hydraulic motors coupled to the work pumps, the hydraulic motors having hydraulic connections connected between the work pumps and the pressing cylinders in the feeding circuit, the hydraulic motors further being connected to a tank.

13. The upsetting press according to claim 12, wherein hydraulic motors are connected to the tank through a cooler.

* * * * *